United States Patent [19]

Danielsson et al.

[11] Patent Number: 4,558,787

[45] Date of Patent: Dec. 17, 1985

[54] SCREENING DEVICE HAVING A SCREEN DECK COMPOSED OF TWO SCREEN FRAMES

[76] Inventors: Marcus Danielsson, Hammargatan 6, 820 60 Delsbo; Karl O. Ljunglof, Mejerivagen 10; Goran Hassel, Skolvagen 3, both of 820 70 Bergsjo, all of Sweden

[21] Appl. No.: 519,094

[22] Filed: Aug. 1, 1983

[51] Int. Cl.[4] ..... B07B 1/50

[52] U.S. Cl. ..... 209/626; 209/379; 209/396; 209/404; 209/674

[58] Field of Search ..... 209/625, 626, 674, 675, 209/676, 357, 379, 381, 382, 393, 394, 396, 404, 405, 355, 353, 677

[56] References Cited

U.S. PATENT DOCUMENTS

| | | | |
|---|---|---|---|
| 1,492,621 | 5/1924 | Allison | 209/394 |
| 1,552,397 | 9/1925 | Edwards | 209/396 |
| 1,608,640 | 11/1926 | Wilson | 209/396 |
| 2,879,890 | 3/1959 | Romera | 209/394 |

FOREIGN PATENT DOCUMENTS

| | | | |
|---|---|---|---|
| 1303447 | 7/1962 | France | 209/674 |
| 1555028 | 11/1979 | United Kingdom | 209/379 |
| 482209 | 12/1975 | U.S.S.R. | 209/394 |
| 482210 | 12/1975 | U.S.S.R. | 209/396 |

*Primary Examiner*—Robert B. Reeves
*Assistant Examiner*—Donald T. Hajec
*Attorney, Agent, or Firm*—Eric Y. Munson

[57] ABSTRACT

A screening device having a screen deck composed of two screen frames (11, 27) provided with oblong, parallel screening elements (20, 28), the elements (20) of the first frame being arranged between the elements (28) of the second frame. The second frame (27) rests on the first frame (11). The frames are provided with guide and contact elements (22–26, 32) for guiding and retaining the second frame in a predetermined position on the first frame. The second frame (27) can, in order to free material particles which have jammed between the screening elements (20, 28), be raised freely relative to the first screen frame to a predetermined maximum height, the frames and their screening elements remaining parallel to one another. The frames can be resiliently supported for performing oscillating movements relative to a support frame (5) and relative to one another.

6 Claims, 4 Drawing Figures

SCREENING DEVICE HAVING A SCREEN DECK COMPOSED OF TWO SCREEN FRAMES

BACKGROUND OF THE INVENTION

The present invention relates to a screening device. More precisely, the invention refers to so-called riddles and similar screening devices, which usually consist of a support frame provided with legs, in which frame a screen deck with longitudinally extending screening apertures is fitted. The apertures are formed between longitudinally extending screening elements such as, for example, steel bars. As a rule, the deck is inclined downwards from the feed end to the discharge end to allow oversized material not passing through the apertures to be discharged at the lower end of the screen. Screening devices of this kind exist both with and without an auxiliary device in the form of a vibrator to impart a vibrating movement to the deck.

In screen decks of this kind, and particularly in the case of relatively large screening apertures (above approx. 30 mm), blocking of the deck due to oversized material wedging between the screening elements is always a problem. Therefore, several different kinds of cleaning arrangements for this type of deck have been suggested. For example, it is known to arrange every second bar pivotable relative to the other bars around a horizontal shaft at one end of the deck. Thus, every second bar can be pivoted upwards, which increases the distance to the alternating fixed bars so that accumulated material particles will either glide along the deck to its discharge end or fall down through the widened apertures. A disadvantage with the described arrangement is, however, that the movement which increases the apertures is very small near to the pivot axle. Thus, oversized or borderline stones are not freed, but only sink a little deeper into the apertures. This results in still worse jamming, which prevents the bars from being swung back and may cause deformation and damage to the deck when it is attempted to carry out this operation.

SUMMARY OF THE INVENTION

It is an object of the present invention to arrange a screen deck consisting of two sets of screening elements, each set supported by a screen frame, in such a way that one set can be separated from the other without the above-mentioned disadvantage. It is a further object to arrange the screen frames in such a way that—for example with the help of a motor-driven vibrator fitted to one of them—oscillating movements can be imparted to the screen frames relative to a support frame as well as relative to one another, which will counteract blocking of the deck and, consequently, make it necessary to clean the deck less frequently by means of separating the deck bars. These objects have been attained with the device in accordance with the present invention as defined in the claims.

BRIEF DESCRIPTION OF THE DRAWING

The device will be described in closer detail in the following, with reference to the attached drawings, of which

DETAILED DESCRIPTION OF THE INVENTION

Figure 1:
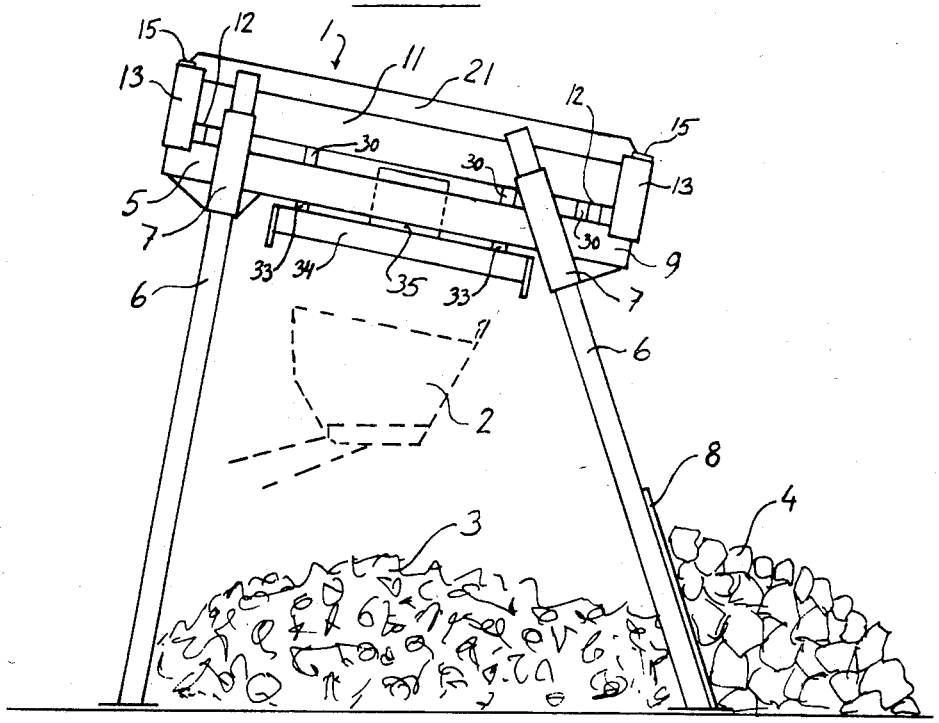
FIG. 1 shows a side view of the screening device installed in working position, FIG. 2 an end view, the left-hand half of which shows the screen deck in accordance with the invention in the working position, while the right-hand half shows the cleaning position with the screen bars separated from each other.

The screening device in general is designated 1 in the drawings, 2 is a bucket of a loading machine, indicated by dashed lines, 3 denotes screened undersize material and 4 separated oversize material which has passed over the screen deck. The screening device includes a support frame 5 having four legs 6 which are suitably arranged (not shown) in tubular holders 7 fixed to the support frame. In this manner, the inclination and height above the ground of the support frame can be changed by adjusting the length of one or both pairs of legs. On the pair of legs at the discharge end, a plate or similar member is suitably fitted to act as a partition between the oversize material and the undersize material which has passed through the screen deck.

The support frame 5 includes two longitudinal frame girders 9 and two transverse frame girders 10. On these, a first screen frame 11 is supported by means of resilient elements 12, such as coil springs. At the four corners of the support frame, and with play against the screen frame 11, buffers 13 are arranged which have a vibration damping and shock absorbing lining 14, said buffers serving to limit the movements of the screen frame in the longitudinal and transverse directions. On top of the buffers, stops 15 are fitted which limit the upward movement of the screen frame 11, thereby preventing it from being lifted off, or jumping off, its supporting springs 12. Between the springs and the screen frame 11, and the frame girders 9 of the support frame, respectively, spring guides are, of course, arranged in the usual way, which are not shown.

The first screen frame 11 includes two longitudinal sections 16, a rear, transverse section 17 and an additional number of transverse sections of a lower height, designated 18. On the sections 18, short upright support irons 19 are fitted which support screening elements 20 in the form of bars. At their rear ends, these are also fastened to the transverse section 17. The longitudinal sections 16 of the screen frame serve as a mounting for two inclined overflow protector plates 21. Two of the transverse sections 18 are each fitted with one pair of supporting brackets, each consisting of a bracket 22 fitted below the transverse sections by means of two supporting irons 23 extending downwards from the sections. The top surface of the brackets is fitted with a lining of resilient material, or with rubber buffers or the like. Further, the two transverse sections 18 in question are each fitted with two short contact plates 25 extending in the longitudinal direction of the sections and forming an extension downwards of one side of these. At right angles to the plates 25 and connected to one side of these, upright lateral guiding plates 26 are fitted to the sections and extend from the top edge of these to a distance below their bottom edge.

The second screen frame 27 consists of stave-like screening elements 28 fitted to supporting irons 29, which are in turn fitted to a number of transverse sections 30 which hold the frame structure together. At their rear ends, the stave-like screening elements are, in addition, held together by means of a transverse flat bar 31 fastened to them. The screen frame 27 rests, by means of two of its transverse sections 30, on the bracket 22 via the bracket's resilient lining or rubber buffer (see FIG. 2, left-hand portion, and FIG. 3). Further, the second screen frame 27 rests resiliently, via buffers 32, against the contact plates 25 which form an extension downwards of one side of the transverse sections 18 of the first screen frame. The buffers 32 are, in addition, guided laterally by the lateral guiding plates 26 of the said transverse sections 18. The buffers 32 can be made in the form of rollers coated with resilient material which run on the lateral guiding plates 26.

By means of supporting irons 33, a lifting bracket 34 is fitted on two transverse sections 30 of the second screen frame, which bracket can also support a schematically illustrated vibrator 35 which should be covered in a suitable way as protection against material falling through the screen deck.

Installation of the second screen frame 27 is carried out in such a way that the complete frame is put in its place inside the first screen frame 11, against the support and guide members 22–26, before the screening elements 20 of the first frame have been connected to its transverse sections 17, 18. After the screening elements 20 have been fitted, these will serve as stops in the upward direction for the transverse sections 30 of the second screen frame.

The screening device functions in the following way: Material to be screened is, by means of a loader bucket or the like, fed to the screen deck composed of the two screen frames 11, 27, which are then in the working position in accordance with FIG. 2, left-hand half, and FIG. 3. Undersize material 3 falls down through the apertures between the screening elements 20, 28 and forms a pile below the screening device. Undersize and oversize material is kept apart by means of the plate 8. Material is suitably fed to the screening device close to its highest end. If the screen deck is given a sufficient inclination, the screening device can work without a vibrator 35. The device will, however, require less elevation and work more efficiently with a vibrator, which will permit a lesser inclination of the screen deck and enhanced material transport with consequent minimized risk of blocking of the screen openings. The vibrator 35 can, for example, be of the type which by means of rotating off-centre weights produces a substantially circular movement. This movement is, by the lifting bracket 34, transmitted to the second screen frame 27, which is connected to the first screen frame 11 via the resilient elements 24, 32. The first screen frame, in its turn, is resiliently supported on the spring elements 12.

The screen frames form a two-mass system with the first and the second frames oscillating relatively to one another. The second frame 27, which can be made lighter than the first frame and which is driven directly by the vibrator 35, can be given the largest oscillating movement. Since only one of the frames is driven, and a relative movement is obtained between the screening elements of the frames, a particularly good transport and cleaning effect of the deck is attained. It is therefore possible to use a lower vibrator output than if, in the conventional way, the whole screen frame were vibrated with a common movement of all the screening elements.

The efficient, continuous cleaning which is obtained by the relative movements of the screening elements 20 and 28 produces the result that only the borderline particles, i.e. material particles which have a dimension only slightly exceeding the width of opening in the screen deck, and which have a shape that gives them a pronounced tendency to wedge, will be stuck between the screening elements. Therefore, the screening device can, as a rule, carry out a substantial amount of work before the screen openings are blocked to a troublesome degree. How quickly or slowly the blocking takes place will, to a great extent, of course also depend on the selected screen opening size and the amount of troublesome borderline size particles in the feed.

Figure 4:
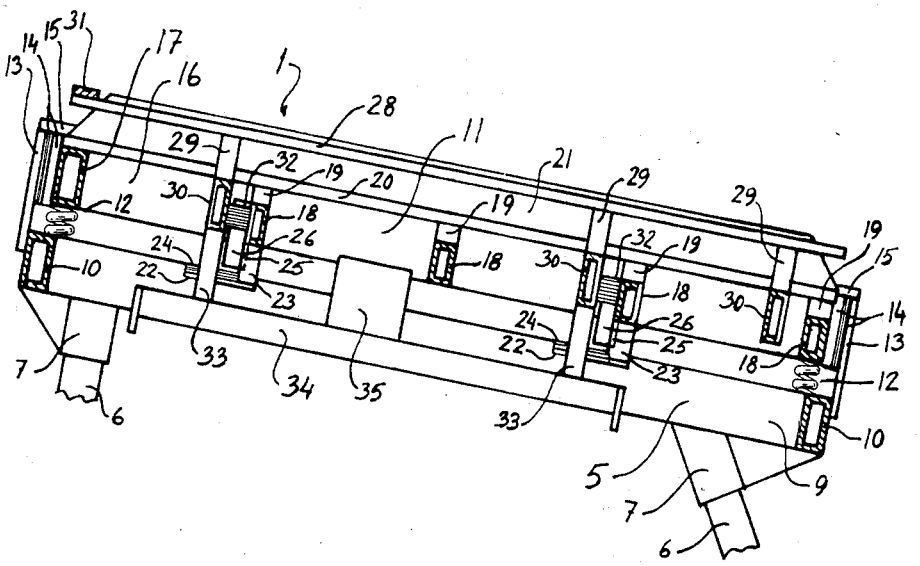

When it is required to clean the screen deck of wedged material particles, the loading bucket 2 is positioned against the underside of the lifting bracket 34, and the second screen frame 27 is raised until its transverse sections 30 contact the underside of the screening elements 20 of the first screen frame. It is, of course, also possible to arrange stops between the lifting bracket 34 and the support frame 5, in order not to load the first screen frame 11 with the lifting forces. The screening elements 20 and 28 are now separated from each other in accordance with FIG. 2, the right-hand half, and FIG. 4. During the lifting operation, the vibrator 35 can go on operating, which enhances the cleaning effect. The wedge borderline size particles will now either glide along the screening elements 20, 28 and fall down from the discharge end of the screening device, or fall down between the screening elements.

Since, for screening devices of the kind discussed herein, a very accurate separation limit between the material fractions is, as a rule, not required, and since, mainly, only the real borderline size particles will wedge between the screening elements, it is in most cases acceptable to let the borderline size particles which fall through the deck when the cleaning operation is carried out mix with the underize material 3. If, in certain cases, this should not be acceptable, the possibility exists of removing the undersize material before commencing the lifting and cleaning operation, after this operation is finished, to take away the borderline size particles which have fallen down.

The buffers 13 lined with resilient material 14 are suitably placed at such a distance from the screen frames 11, 27 that no portions of the latter will come into contact with the buffers during the normal oscillations of the frames. On the other hand, the buffers will come into function when the oscillating movements are increased, for example due to heavy loads during the feeding material from the loader bucket 2 or during passage of the so-called critical speed when the vibrator 35 is started or stopped.

The relative movements between the screen frames 11 and 27 have as a result that only part of the total amplitude of the two-mass system effects the spring suspension 12. Therefore, the transmission of vibrations to the support frame 5 is insignificant.

When the screen deck is cleaned by means of raising the second screen frame 27, the frame is guided laterally through co-operation between the buffers 32 and the lateral guide plates 26, and in the forward direction through co-operation between the buffers 32 and the contact plates 25, or the side of two transverse sections 18 during the stage when the buffers pass above the plates. In the drawings, no guiding means in the rearward direction are shown. The length of the bracket 22 provides room for a rearward movement, however, if lifting is done obliquely. As soon as the second frame is again lowered onto the bracket 22, it will, due to the inclination and the vibrations, move forwards until the buffers 32 contact the plates 25. Besides, it is a simple matter to arrange stops which limit the rearward movement of the second frame 27 when it is raised.

Guiding the second screen frame 27 laterally can, of course, be done in other ways than by means of the vertical guide plates 26 and buffers 32 made in the form of rollers. The embodiment shown, where the outer ends of the transverse sections 30 are arranged with play against the longitudinal sections 16 of the first screen frame and the lateral guiding function is by means of the buffers 32 which act as rollers is, however, advantageous. This design prevents the second screen frame from jamming, if it is raised or lowered obliquely, and minimizes the strain on the guide elements.

To carry out the lifting operation, the bucket 2 is suitably applied from a position of the loader which is behind the screening device, i.e. in accordance with FIG. 1. Thus, the lifting movement will describe an arc in the upwards-backwards direction. The buffers 32 will therefore go clear of the contact plate 25 and will not regain contact with the latter until the last stage of the lowering movement, which describes the same course of movement. The buffers are, in this way, not subjected to strains caused by strong friction against the guide surfaces.

Spillage guards (not shown) are suitably arranged over the buffers 32, for example in the form of rubber strips or plates protruding from the neighbouring transverse sections, in order to prevent abrasive particles from coming between the buffers and the lateral guide plates 26.

The slightly elastic lateral guiding of the second screen frame 27 by means of the buffers 32 permits also a certain degree of relative lateral movement of the screening elements 20, 28 during the screening operation, which improves the continuous cleaning of the screening apertures.

The elastic guiding of the screen frames 11, 27 relative to one another, together with the spring suspension 12 and the buffers 13, which are lined with elastic material, eliminates rattle and metal-to-metal contact during the operation of the screening device with constant reduction of the noise factor. Furthermore, the screening elements and other parts are protected, thanks to the dampening effect of the elastic elements, especially when heavy pieces of material fall down onto the screening device from the loader bucket.

The manner of achieving the separation of the screening elements according to the invention has no negative effect on the stability of the screen deck, as is the case in prior art screen decks which are provided with screening elements which are pivotable relative to one another or can be separated in other ways. If necessary to any degree necessary, lateral stiffeners may be arranged between the screening elements 20, 28 at their ends as well as at several points therebetween.

Figure 2:
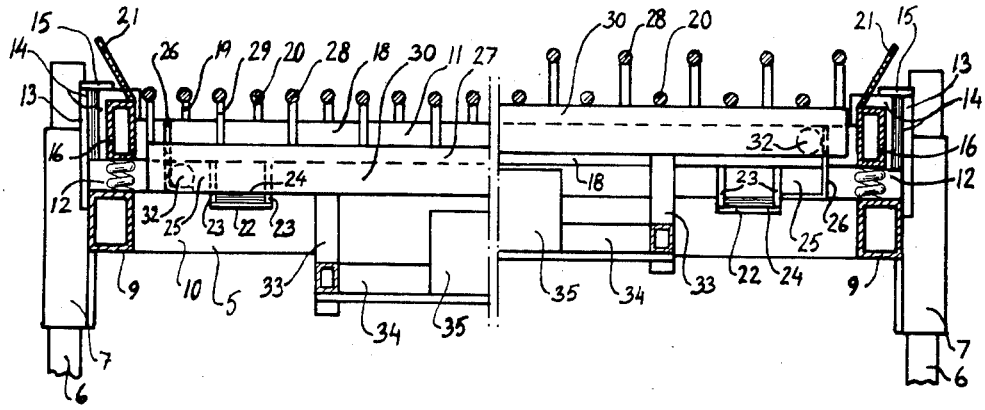
Figure 3:
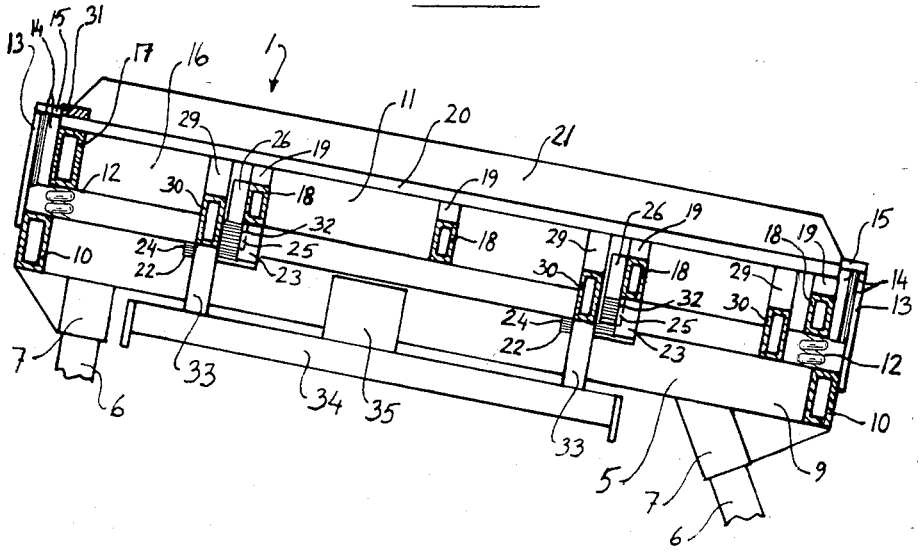
FIGS. 3 and 4 show sectional side views with the screen deck in working and cleaning positions, respectively.

As shown by FIG. 2 it may be advantageous to provide the outermost screening element with means 28 as part of each side of the screening device on the second screen frame 27 which can be raised and lowered. This ensures that particles which have wedged between the outermost screening elements and the skirting boards 21 or the frame sections 16 are freed when the frame is raised.

The drawings show an embodiment of the invention by way of example only, and it is selfevident that variations of the design are possible within the scope of the invention as defined by the claims.

We claim:

1. A screening device for shifting particulate material, comprising:

(a) a first substantially rectangular-shaped frame (11) including a plurality of spaced substantially parallel screening bars (20);

(b) a supporting frame (5);

(c) first resilient means (12) connecting said first frame to said supporting frame;

(d) a second substantially rectangular-shaped frame (27) supported on said first frame (11) and including a plurality of spaced substantially parallel screening bars (28) extending alternately between said screening bars (20) of said first frame (11) to form together a common screening deck for sifting particulate material of predetermined size;

(e) said second frame (27) being provided with supporting members (29) extending downwardly between said screening bars (20) of said first frame (11) and connected to at least two transverse members (30) located at a spaced distance beneath said screening bars (20) of said first frame (11) for maintaining said screening bars (28) of said second frame (27) in assembled condition;

(f) second resilient means (24–26, 32) allowing said second frame (27) to rest freely on said first frame (11);

(g) vibrator means (35) for oscillating said second frame (27) relative to said first frame to provide a two-mass oscillatory screening system;

(h) means connected to said transverse members (30) for raising said second frame a distance above said first frame to free said common screening deck of entrapped oversized particulate material; and (i) said raised distance being limited by the movement of said transverse members (30) into contact with the said screening bars (20) of said first frame (11).

2. A screening device according to claim 1, including means (6, 7) for inclining said supporting frame.

3. A screening device according to claim 1, in which said means for raising said second frame (27) includes a lifting bracket (34) interconnecting said transverse members (30) and adapted to be activated by a loading bucket used for loading the particulate material on said common screen deck.

4. A screening device according to claim 3, in which said vibrator means (35) is supported by said lifting bracket (34).

5. A screening device according to claim 1, including resilient buffer means (13,14) on said supporting frame (5,6) for restricting the oscillatory movement of said first frame (11) and said second frame (27).

6. A screening device according to claim 1, in which said first frame (11) and said second frame (27) are provided with co-operating means (22–26, 32) for guiding and maintaining said second frame (27) in its predetermined position relative to said first frame (11) during the operation of said device.

* * * * *